United States Patent [19]

Muller

[11] Patent Number: 4,646,379

[45] Date of Patent: Mar. 3, 1987

[54] CONCRETE DECK TRUSS BRIDGE AND METHOD OF CONSTRUCTION

[75] Inventor: Jean M. Muller, Tallahassee, Fla.

[73] Assignee: Figg and Muller Engineers, Inc., Tallahassee, Fla.

[21] Appl. No.: 814,059

[22] Filed: Dec. 27, 1985

[51] Int. Cl.[4] ..... E01D 21/04

[52] U.S. Cl. ..... 14/23; 14/13; 14/1; 52/223 L

[58] Field of Search ..... 14/1, 13, 14, 21, 23, 14/26; 52/223 L, 223 R, 226, 225

[56] References Cited

U.S. PATENT DOCUMENTS

| | | | |
|---|---|---|---|
| 20,987 | 7/1858 | Briggs . | |
| 26,583 | 12/1859 | Gray . | |
| 34,023 | 12/1861 | Yerk . | |
| 78,797 | 6/1868 | Foreman . | |
| 81,960 | 9/1868 | Thompson . | |
| 127,791 | 6/1872 | Partridge . | |
| 328,758 | 10/1885 | Carr . | |
| 2,155,121 | 4/1939 | Finsterwalder | 52/225 |
| 2,898,757 | 8/1959 | Finsterwalder | 52/223 R |

FOREIGN PATENT DOCUMENTS

| | | | |
|---|---|---|---|
| 869976 | 3/1953 | Fed. Rep. of Germany | 14/1 |

*Primary Examiner*—Stephen J. Novosad
*Assistant Examiner*—Michael A. Goodwin
*Attorney, Agent, or Firm*—Watson, Cole, Grindle & Watson

[57] ABSTRACT

A concrete deck truss bridge and method of constructing same employing precast compression and tension diagonals with the latter having oppositely extending feet at opposite ends so as to define therein surfaces for support of the intervening compression diagonals, and opposite sides of the feet defining anchor blocks for post-tension tendons. Construction proceeds from main span piers toward the mid-span and end span piers under balanced loading, in sequence.

14 Claims, 13 Drawing Figures

CONCRETE DECK TRUSS BRIDGE AND METHOD OF CONSTRUCTION

BACKGROUND OF THE INVENTION

This invention relates generally to a concrete deck truss bridge having its roadway on the top of the supporting structure, and a method of constructing such a bridge.

Prior techniques employed in the construction of concrete deck truss bridges, whether precast and/or cast in place, normally require heavy ground equipment at various work stations for moving the bridge elements to the span to be erected, erecting the concrete forms and bridge elements, dismantling the concrete forms, etc. The end spans of the bridge are typically erected using different techniques compared to erection of the main span, and problems arise when constructing the bridge spans from opposite sides of a bridge pier, in that static loads and wind loads cause undue torsional forces at the pier mainly due to unbalanced loading during construction. Special or additional equipment is therefore required to guard against these problems. Moreover, the concrete forms required for casting are unwieldy, and precast bridge elements may be of such size and weight as to add significantly to the time and expense of bridge construction.

SUMMARY OF THE INVENTION

It is therefore an object of the present invention to construct a concrete deck truss bridge with a minimum of ground equipment and without the need for special equipment, and employing the same technique for the end spans as well as the main span, in a highly efficient and economical manner at significantly reduced time and expense.

Another object of this invention is to provide such a bridge construction which starts from the main span piers toward the main span midpoint and simultaneously toward the end span piers, in succession, so as to avoid unbalanced loads at the main span piers during construction.

A further object of the present invention is to provide such a bridge construction in which pairs of concrete truss beams are constructed on opposite sides of the main and end span piers, each of the beams comprising interconnected alternating compression and tension diagonals of concrete, concrete deck slabs and concrete bottom slabs, and starting at the main span pier upwardly diverging pairs of the compression diagonals are erected on opposite sides of the pier. Proceeding toward the centerline between the main span piers and simultaneously toward the end span piers, the tension diagonals are erected as downwardly diverging, and the remaining of the compression diagonals are erected as upwardly diverging by extending upper ends of the tension diagonals respectively from upper ends of previously erected compression diagonals, and extending lower ends of the compression diagonals from lower ends of previously erected tension diagonals. As the diagonals are erected, the deck slabs are installed respectively between the upper ends of the tension diagonals, and the bottom slabs are installed respectively between the lower ends of the tension diagonals, and a first of the deck slabs is connected to the top of the main span pier. The upper and lower ends of the tension diagonals define upper and lower feet having bearing surfaces for the compression diagonals, the upper feet extending toward the main span piers form the main span centerline and from the end span piers, and the lower feet extending away from the main span piers toward the main span centerline and toward the end span piers.

A still further object of this invention is to provide such a bridge construction in which the compression diagonals are temporarily supported on stabilization trusses spanning the end and main span piers, the trusses being shifted toward the main span centerline as the erecting steps proceed.

A still further object is to provide such a bridge construction in which a bottom slab form is initially attached to the main span pier to facilitate a casting in place of the bottom slabs adjacent the main span pier, this form being removed upon casting completion, and other bottom slab forms being attached, in succession, to the cast bottom slabs to permit next adjacent bottom slabs to be cast in place.

A still further object is to provide such a bridge construction in which deck slab lifting equipment, which may be in the form of a swivel crane, is supported on the first deck slab over the main span pier for installing an adjacent deck slab at the main span, such equipment being progressively moved over each adjacent deck slab for successively installing the deck slabs for the main span up to the main span centerline, the deck slabs for the end spans being installed successively and simultaneously with the successive installation of the main span deck slabs.

A still further object is to provide such a bridge construction in which upper steel post-tension tendons span respectively across the main span piers and connect together the upper ends of designated ones of the tension diagonals at the end span to the upper ends of like ones of the tension diagonals lying between the main span and the main span centerline.

A still further object is to provide such a bridge construction technique in which anchor blocks are provided on the bottom slabs at the main span centerline and adjacent thereto in the vicinity at the center of the main span, and lower steel post-tension tendons are anchored between the anchor block at the centerline respectively in opposite directions to the other anchor blocks and to the lower ends of the tension diagonals adjacent thereto.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4, 5:
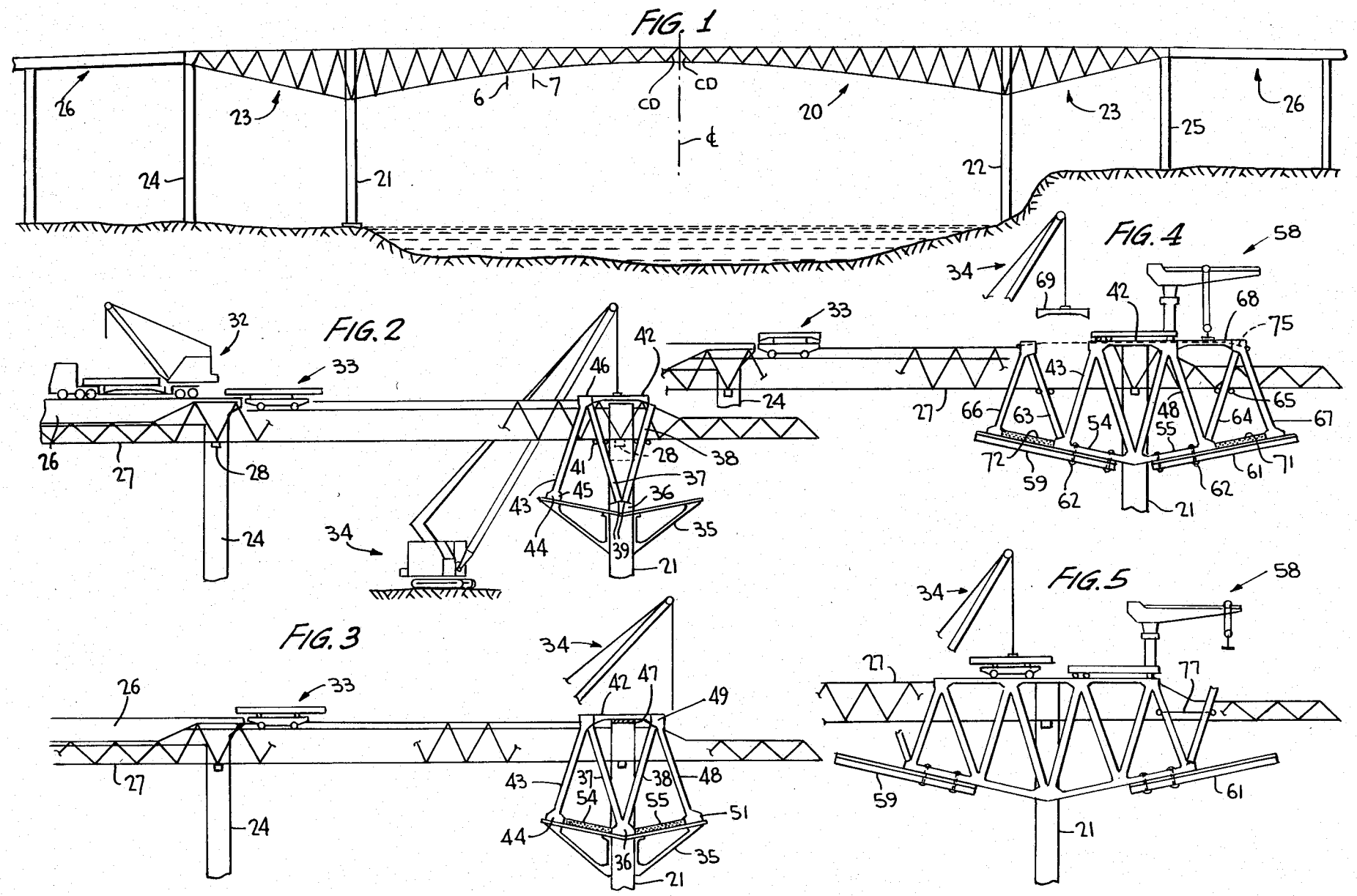
FIG. 1 is a schematic side elevational view of a completed concrete deck truss bridge in accordance with the invention.
FIGS. 2, 3, 4 and 5 are side elevational views showing the progressive steps employed in constructing the FIG. 1 bridge starting at the main span piers.
Figure 6:
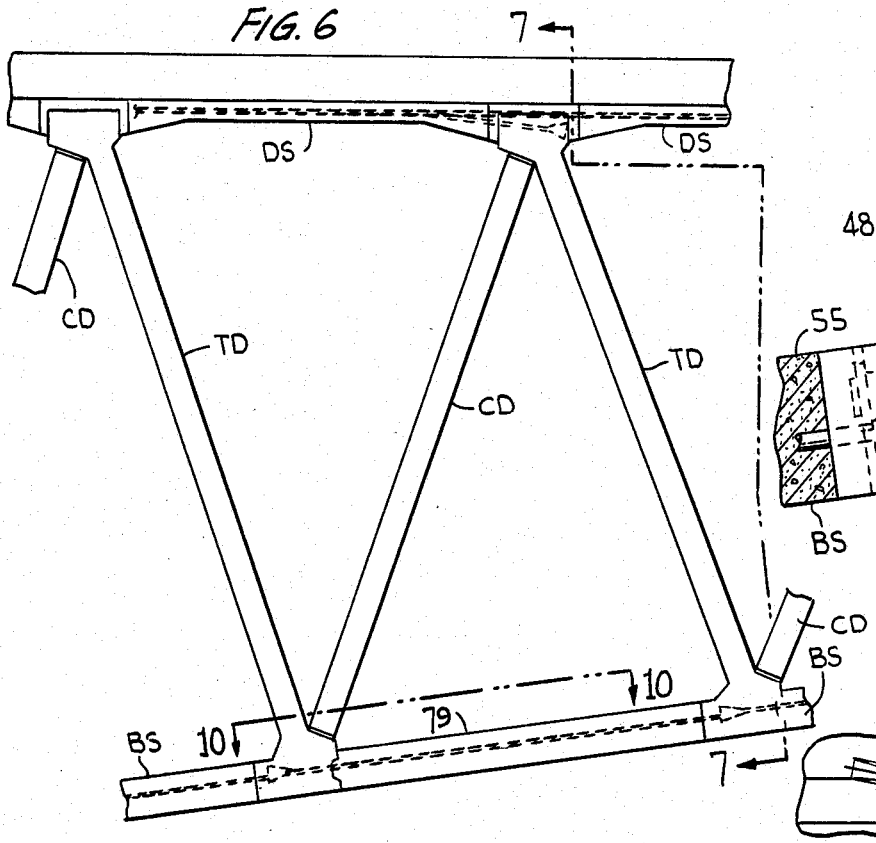
FIG. 6 is an enlarged detail view, in side elevation, of the assembled tension and compression diagonals, and the deck and bottom slabs.

Turning now to the drawings wherein like reference characters refer to like and corresponding parts throughout the several views, a completed concrete deck truss bridge is shown in general outline in FIG. 1 as having a main span 20, main span piers 21, 22, end spans 23, and end span piers 24, 25. Approach spans 26 are constructed in some manner forming no part of this invention, and merge with the end spans. Typically, the main span extends across a flowing body of water, as shown, or a ravine of some type.

FIGS. 2–5 illustrate the sequence of erecting the main and end spans starting at main span pier 21 which proceeds simultaneously toward end span pier 24 and toward the centerline of the main span. The same procedures are applied (not shown) starting at main span pier 22 so as to proceed toward end span pier 25 and simultaneously toward the centerline of the main span. Sections are then finally joined together at this midpoint of the span.

A pair of stabilization trusses 27, only one of which is shown in FIGS. 2–5 and 7, are provided on opposite sides of piers 21 and 24 on laterally extending brackets 28. The trusses may rest on hydraulic or pneumatic jacks 29 and rollers 31 (FIG. 7) to respectively permit vertical adjustment and a shifting of the trusses toward the main span centerline during bridge construction.

Loading equipment, such as a crane vehicle 32, delivers the bridge precast elements and the formwork equipment by conveniently moving along the previously completed approach span 26, and unloads the elements and equipment onto a travelling dolly 33 capable of travelling along one or both of the stabilization trusses. The dolly transports the load it carries within the reach of a ground crane 34, as required. With the crane, bottom slab forms 35 are attached to pier 21 at opposite sides beneath support blocks 36 extending laterally from the pier (see also FIG. 7). Otherwise, these support blocks 36 may be cast in place using forms 35. At each side of the pier, a pair of compression diagonals 37, 38 are erected with the lower ends 39 thereof bearing against the support block and diverging upwardly relative to each other, as shown. The compression diagonals are precast of reinforced concrete, and may be square, rectangular or circular in cross-section. And, these diagonals are temporarily attached to the truss by removable connecting ties 41. A center deck slab 42 is mounted at its center over the top of pier 21, and with the use of shims 30 between the truss and the bottom of slab 42 (FIG. 7), the slab is positioned to the required level and alignment. A tension diagonal 43 is erected so as to be supported at its lower end 44 on form 35. This tension diagonal diverges downwardly from its adjacent compression diagonal 37 and, as with all the compression diagonals employed for the bridge, is pretensioned and precast and may be of square, rectangular, or circular cross-section. Also, each tension diagonal has a lower foot such as 45 at its lower end and an upper foot such as 46 at its upper end.

The center deck slab 42 is then cast in place as at 47 (FIG. 3) to the top of the pier to lock it in place. A tension diagonal 48 (FIG. 3) is then installed such that its upper end extends from the upper end of compression diagonal 38 and diverges downwardly therefrom such that the lower end of the tension diagonal rests on form 35. Tension diagonal 48 likewise has upper and lower feet 49 and 51 similar to the upper and lower feet of tension diagonal 43 except extending in different directions relative to pier 21. For example, it can be seen that the upper feet of each of the tension diagonals extend toward pier 21 from the end piers and from the centerline of the main span pier. And, each of the lower feet of the tension diagonals extends away from the main span piers toward the end span piers and toward the centerline of the main span.

Figure 9:
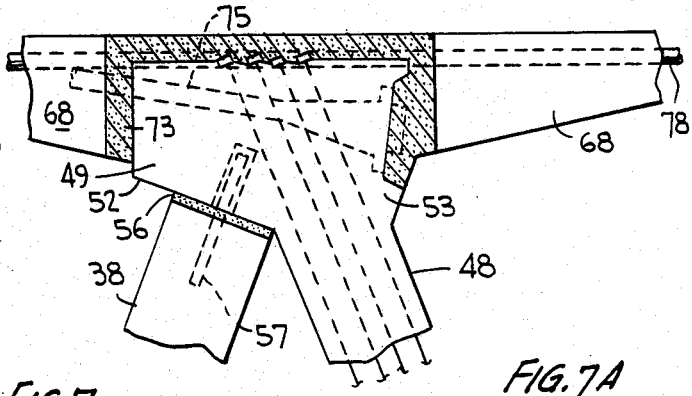
FIG. 9 is an enlarged detail view of a typical joint between the upper foot of a tension diagonal, an upper end of a compression diagonal, and ends of adjoining deck slabs.
Figure 7:
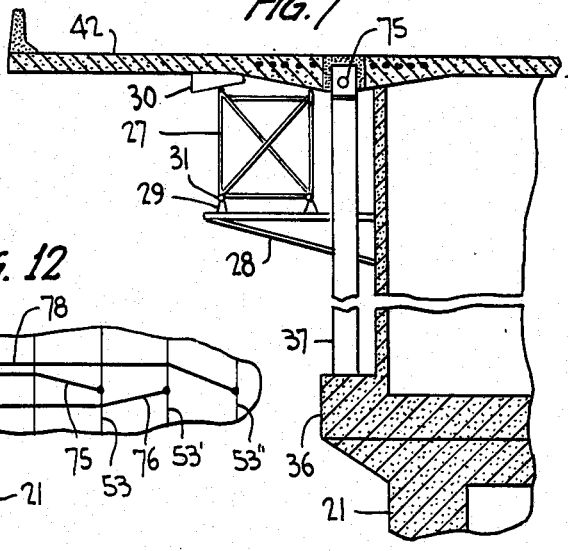
FIGS. 7 and 7A are cross-sectional views taken substantially along the line 7—7 of FIG. 6, respectively showing half-sections at the main span pier and at the main span centerline.
Figure 7A:
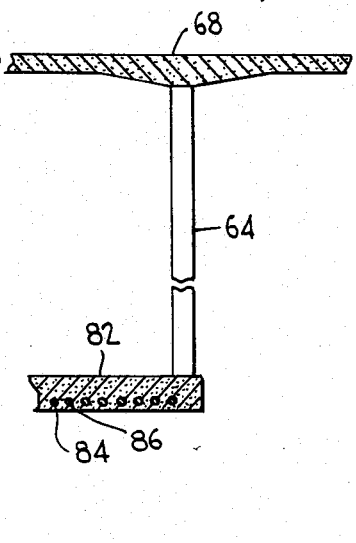

Upper foot 49 of tension diagonal 48, which is typical for all the tension diagonals, is shown in detail in FIG. 9 as having a bearing surface 52 lying perpendicular to the central axis of the compression diagonal which bears thereagainst at its upper end. And, a side 53 of the upper end of the tension diagonal, opposite foot 49, forms an anchor block for purposes to be more fully described hereinafter.

Bottom slabs 54 and 55 are then cast in place over form 35 respectively between block 36 and feet 44, 51, the joints between deck slab 42 and upper feet 46 and 49 are cast in place, and joint 56 (FIG. 9) is cast in place between the compression diagonals and the upper feet of the tension diagonals. Tie bars 57 may be employed for strengthening the joint at 56.

The post-tension bars of deck slab 42 and the transverse post-tension bars of the bottom slabs are then stressed.

Figure 8:
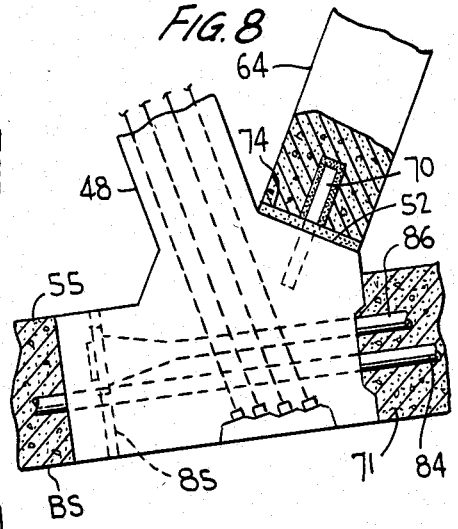
FIG. 8 is an enlarged detail view of a typical joint between the bottom foot of a tension diagonal, the lower end of a compression diagonal, and ends of adjoining bottom slabs.

Deck erecting equipment, which may be in the form of a swivel crane 58, is mounted over center deck slab 42 which overlies the main span pier. Bottom slab form 35 is removed from the pier, and other bottom slab forms 59 and 61 are attached as at 62 (FIG. 4) to bottom slabs 54 and 55 so as to extend outwardly away from pier 21 and underly adjoining sections of the bridge to be erected from the diagonals. Further compression diagonals 63 and 64 are erected so that the lower ends thereof respectively abut against the lower feet of tension diagonals 43 and 48 and diverge upwardly therefrom, as shown. These compression diagonals are temporarily attached to truss 27 by removable connecting ties 65 for proper positioning. Further tension diagonals 66 and 67 are positioned so as to extend from the upper ends of diagonals 63 and 64 diverging downwardly therefrom with bearing surfaces 52 thereof abutting against the upper ends of these adjoining compression diagonals. The lower ends of diagonals 66 and 67 bear against forms 59 and 61. Diagonals 64 and 67 may conveniently be erected as aforedescribed with the use of swivel crane 58, and diagonals 63 and 66 may be erected as aforedescribed by ground crane 34. A deck slab 68 is then erected by the swivel crane so as to extend between the upper ends of tension diagonals 48 and 67, and a deck slab 69 is erected by the ground crane so as to extend between the upper ends of tensional diagonals 43 and 66. These deck slabs 68 and 69, because of their heavy mass and size relative to that of the diagonals, may be installed practically simultaneously so as to maintain balance at the main span pier during bridge construction. Further, bottom slabs 71 and 72 are then cast in place on the bottom form, the joints 56 (FIG. 9) are cast in place between the diagonals, the joints 73 between the installed deck slab 68 and upper foot 49 is cast in place, and joint 74 between the compression diagonal and the lower foot of the tension diagonal (FIG. 8) is cast in place. Tie bars 70 may be employed for the compression diagonals.

Upper post-tension tendons 75 (FIGS. 4 and 12) are then stressed, and bridge construction continues as the swivel crane is moved forward to overly deck slab 68 (FIG. 5). The precast bridge elements are then lifted by the ground crane from the truss onto the traveling dolly so as to be moved along the completed structure to a location behind the swivel crane. Bottom forms 59 and 61 are moved to the adjoining bridge segments to be erected, the trusses moved forwardly as shown, the diagonals installed using temporary connecting ties for the compression diagonals, the deck slabs installed, and the bottom slabs cast in place after which the joints at the upper and lower nodes are cast in place, all as aforedescribed. Upper post-tension tendons 76 (FIG. 12) are then stressed, the equipment is moved forward and the operation cycle is repeated until the end span reaches pier 24 and the main span reaches the midpoint at the main span centerline. Depending on the length of the main span, the truss will no longer be moved forwardly, but rather connecting ties 77 will be employed for temporarily positioning the compression diagonals during bridge construction.

Figure 12:
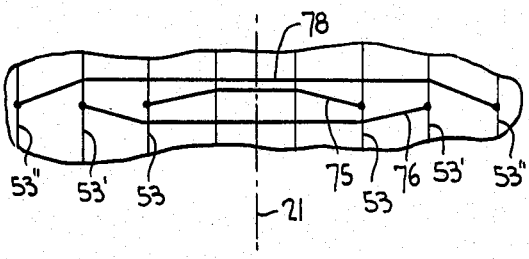
FIG. 12 is a plan view showing part of the array of upper steel post-tension tendons anchored in place across a main span pier.

Sides 53 at the upper ends of the tension diagonals define anchor blocks for the upper, steel, post-tension tendons shown in part in FIG. 12, and typically shown in FIGS. 4 and 9. Thus, after tension diagonals 66 and 67 and deck slabs 68 and 69 are installed (FIG. 4) and the joints at the nodes are cast in place, upper post-tension tendons 75 are stressed, these tendons extending through the installed deck slabs and upper ends of the tension diagonals, as shown in FIG. 4. Thus, tendon 75 spans between sides 53, 53 on opposite sides of pier 21 post-tension tendons 76 extend between sides 53', 53' of the next adjoining bridge segments, post-tension tendons 78 span across the main span pier between sides 53'', 53'' of the next adjacent bridge segments, and so on for each of the constructed segments up to the last adjacent the main span centerline.

Figure 10:
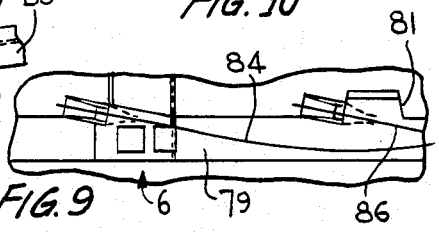
FIG. 10 is a detail view showing representative lower steel post-tension tendons anchored in place, taken substantially along the line 10—10 of FIG. 6.
Figure 11:
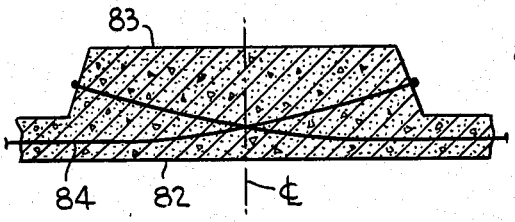
FIG. 11 is a detail view of the bottom slab having an anchor block at the main span centerline, representative lower steel post-tension tendons being shown anchored thereto.

Lower, steel, post-tension tendons are typically required for the structural integrity of the bridge, and are anchored to the midspan bottom slab according to the invention. Thus, for example, after station 6 (FIG. 1) is reached during bridge construction, bottom slab 79 (FIG. 10) is cast with an inwardly extending anchor block 81, and the remaining bottom slabs to the midpoint of the main span are similarly cast except that bottom slab 82 is cast with an upwardly extending anchor block 83 at the main span centerline (FIG. 11). A lower tendon 84 is anchored at one end to an anchor block 85 (FIG. 8) at the lower end of the tension diagonal at station 6, this anchor block being formed at a side of the lower end opposite the foot. Tendon 84 may extend through the remaining bottom slabs and lower feet of the tension diagonals such that its other end is anchored to anchor block 83 of bottom slab 82 at the midspan. Similarly, a lower tendon 86 is anchored at one end to anchor block 81 located between stations 6 and 7 and has its opposite end anchored to block 83. Lower tendons at the remaining stations proceeding toward the midspan are similarly provided and anchored to block 83, from both sides of the midspan, as typically shown in FIG. 11.

From the foregoing, it can be seen that the upper and lower ends of each of the tension diagonals has feet extending in opposite directions and defining bearing surfaces confronting the ends of the intervening compression diagonals which are supported on these bearing surfaces. The deck slabs extend between the upper ends of the tension diagonals, and the bottom slabs extend between the lower ends of the tension diagonals. And, anchor blocks are formed on the upper and lower ends of the tension diagonals at sides opposite the foot, for conveniently anchoring the upper and lower post-tension tendons.

The unique structure of the diagonals and slabs facilitates bridge construction in an expeditious and efficient manner with minimum equipment required. Bridge construction commences at each main span pier by positioning upwardly diverging compression diagonals thereat, and bridge construction proceeds toward the end spans and midspan with balanced loads. Upon reaching the midspan, the downwardly diverging compression diagonals thereat (FIG. 1) are cast in place at their upper ends for bridge completion, and the lower tendons may be conveniently tensioned at the mid span.

Obviously, many modifications and variations of the present invention are made possible in the light of the above teachings. It is therefore to be understood that within the scope of the appended claims the invention may be practiced otherwise than as specifically described.

What is claimed is:

1. A concrete deck truss bridge having at least two end spans and a main span therebetween, comprising a pair of longitudinally spaced apart main span piers, end span piers longitudinally spaced outwardly of said main span piers, pairs of truss beams on opposite sides of said main span and end span piers, each of said beams comprising alternating compression and tension diagonals of concrete, support blocks mounted on said opposite sides of said main span piers, said diagonals including first pairs of said compression diagonals diverging upwardly from lower ends thereof which bear against said support blocks, second pairs of said compression diagonals at the centerline between said main span piers diverging downwardly from the upper ends thereof, upper and lower feet at opposite ends of said tension diagonals, said upper feet extending toward said main span piers from said centerline and from said end span piers toward said main span piers, and said lower feet extending away from said main span piers toward said centerline and toward said end span piers, said feet having bearing surfaces confronting opposite ends of said compression diagonals which are seated against said surfaces, bottom concrete slabs extending between said lower feet and transversely between said diagonals of said pairs of truss beams, and concrete deck slabs extending between said upper feet and transversely between and outwardly of said diagonals of said pairs of truss beams.

2. The bridge according to claim 1, wherein said deck slabs at said piers are connected to the tops thereof.

3. The bridge according to claim 1, wherein upper steel post-tension tendons span across said main span piers, respectively, and connect together upper ends of designated ones of said tension diagonals at said end span to said upper ends of like ones of said tension diagonals lying between said main span pier and said centerline.

4. The bridge according to claim 3, wherein said upper ends of said tension diagonals include anchor blocks for anchoring opposite ends of said upper tendons.

5. The bridge according to claim 3, wherein said bottom slab at said centerline and several of said bottom slabs in the vicinity of said centerline each having an anchor block, lower steel post-tension tendons anchored between said anchor block at said centerline respectively in opposite directions to said anchor blocks of said several bottom slabs and to lower ends of said tension diagonals adjacent said anchor blocks said several bottom slabs.

6. The bridge according to claim 5, wherein said lower ends of said tension diagonals include anchor blocks for said lower tendons.

7. A method of constructing a concrete deck truss bridge having a main span defined by a pair of longitudinally spaced main span piers, and an end span at each end of said main span, each said end span having an end span pier longitudinally spaced from one of said main span piers, comprising the steps of constructing pairs of truss beams on opposite sides of said main span and end span piers, each of said truss beams comprising interconnected alternating compression and tension diagonals of concrete, concrete deck slabs and concrete bottom slabs, and each of said beams being constructed by (a) starting at each said main span piers, erecting an upwardly diverging pair of said compression diagonals on said opposite sides of said main span pier, (b) proceeding toward the centerline between said main span piers and simultaneously toward said end span piers, erecting said tension diagonals as downwardly diverging from upper ends of said compression diagonals, and erecting the remaining of said compression diagonals as upwardly diverging from lower ends of said tension diagonals, (c) as said diagonals are erected during steps (a) and (b), installing said deck slabs respectively between said upper ends of said tension diagonals, installing said bottom slabs respectively between said lower ends of said tension diagonals, and connecting a first of said deck slabs to the top of said main span pier, (d) said upper and lower ends of said tension diagonals defining upper and lower feet having bearing surfaces for said compression diagonals, during said erecting step (b) of said tension diagonals, extending said upper feet toward said main span piers from said centerline and toward said main span piers from said end span piers, and extending said lower feet away from said main span piers toward said centerline and away from said main span piers toward said end span piers.

8. The method according to claim 7, wherein said erecting steps for said compression diagonals include the step of temporarily supporting said compression diagonals on stabilization truss means spanning said end and main span piers.

9. The method according to claim 8, wherein said erecting steps for said compression diagonals further includes the step of shifting said truss means toward said centerline of said main span as said erecting steps proceed.

10. The method according to claim 7, comprising the further step of attaching a bottom slab form to each of said main span piers to permit said bottom slabs, adjacent said main span pier, to be cast in place.

11. The method according to claim 10, comprising the further steps of removing said bottom slab form from said main span pier upon completion of said cast bottom slabs, and attaching other bottom slab forms to said cast bottom slabs to permit next adjacent bottom slabs to be cast in place, and successively removing said other forms and attaching same to previously cast bottom slabs until all of said bottom slabs are cast in place.

12. The method according to claim 7, comprising the further step of supporting deck slab lifting equipment on said first deck slab for installing an adjacent deck slab of said main span and progressively moving said equipment on to each adjacent deck slab for successively installing said deck slabs for said main span up to said centerline, said deck slabs for said end spans being installed successively and simultaneously with the successive installation of said main deck slabs.

13. The method according to claim 7, comprising the further step of spanning upper steel post-tension tendons respectively across said main span piers and connecting together said upper ends of designated ones of said tension diagonals at said end span to said upper ends of like ones of said tension diagonals lying between said main span pier and said centerline.

14. The method according to claim 13, comprising the further steps of providing anchor blocks on said bottom slab at centerline and on several of said bottom slabs in the vicinity of said centerline, and anchoring lower steel post-tension tendons bewteen said anchor block at said centerline respectively in opposite directions to said anchor blocks of said several bottom slabs and to said lower ends of said tension diagonals adjacent said anchor blocks of said several bottom slabs.

* * * * *